US005147080A

United States Patent [19]

Assink et al.

[11] Patent Number: 5,147,080

[45] Date of Patent: Sep. 15, 1992

[54] STAPLE FORMING AND STAPLING MACHINE

[75] Inventors: Kenneth Assink; Mitchell J. Weener, both of Holland, Mich.

[73] Assignee: J. R. Automation Technologies, Inc., Holland, Mich.

[21] Appl. No.: 773,130

[22] Filed: Oct. 8, 1991

[51] Int. Cl.[5] ..... B27F 7/21

[52] U.S. Cl. ..... 227/82; 227/88; 227/91

[58] Field of Search ..... 227/82, 85, 86, 87, 227/88, 91, 92, 120

[56] References Cited

U.S. PATENT DOCUMENTS

| | | | |
|---|---|---|---|
| Re. 14,507 | 8/1918 | Hutchinson . | |
| 228,874 | 6/1880 | Coop . | |
| 253,168 | 1/1882 | Miller . | |
| 263,390 | 8/1882 | Coop . | |
| 1,287,607 | 12/1918 | Ashton . | |
| 1,599,704 | 9/1926 | Finn . | |
| 2,959,786 | 11/1960 | Peterssen | 227/86 |
| 3,009,156 | 11/1961 | Lerner | 227/88 |
| 3,751,961 | 8/1973 | Graf | 227/88 |
| 4,318,555 | 3/1982 | Adamski et el. | 227/88 |
| 4,444,347 | 4/1984 | Males | 227/88 |
| 4,505,415 | 3/1985 | Gruen | 227/82 |
| 4,570,841 | 2/1986 | Olesen | 227/85 |

*Primary Examiner*—Frank T. Yost
*Assistant Examiner*—Scott A. Smith
*Attorney, Agent, or Firm*—Price, Heneveld, Cooper, DeWitt & Litton

[57] ABSTRACT

A staple forming and driving apparatus utilizes bulk wire as the starting material. The apparatus has a fixed anvil block and movable forming and driving blocks. The anvil block contains an anvil about which a staple is formed and a stripper member which is normally biased to the extended position covering the anvil block. A forming block has a pair of projecting camming surfaces which, when it approaches the anvil block, causes the stripper member to recede. After the stripper has been cammed back, wire enters the anvil block across the anvil unit until it contacts the opposite side. The forming block continues to advance until a centrally disposed pressure foot contacts the wire holding the wire in place against the anvil. A forming blade on either side of the pressure foot continues to advance, cutting the wire and bending it around the anvil to form a staple. The forming block then recedes, enabling the stripper to remove the formed staple from the anvil and to place it into a guide channel in a guide member. The driving block then advances toward the forming block and the anvil block. A projecting driving blade on the driving block passes over the forming block and into the guide channel on the anvil block driving the formed staple out of the channel and into a workpiece. The driving block then recedes withdrawing the driving blade from the guide channel on the anvil block and the procedure is ready to begin again. In subsequent operations, the anvil and forming blocks are forming a new staple while the driving block drives the previously formed staple.

19 Claims, 4 Drawing Sheets

STAPLE FORMING AND STAPLING MACHINE

BACKGROUND OF THE INVENTION

Early staple forming machines that used bulk wire were hand operated and were commonly used for binding magazines or sections of books. For most applications, bulk wire staple forming was eventually replaced by the preformed staple, the most common example of which is the desk stapler which uses preformed staples which are joined together into a rigid stick form. Many commercial stapling tasks also employ preformed staples, some of which are of a very large size. Machines which employ preformed staples only hold a limited supply (300–500) which must be periodically replenished. For large industrial stapling applications, the lost time in reloading the stapling machines can severely impact production. The preformed staple costs and production time lost in reloading tends to add a heavy financial burden to the overall production cost. In order to reduce these labor and material costs, the inventors of the present invention have developed a new staple forming and driving machine that employs bulk wire in roll form to provide approximately 50,000 to 100,000 staples from a single roll.

SUMMARY OF THE INVENTION

A staple forming and driving apparatus is disclosed which uses a bulk spool of wire to form individual staples. The wire is fed into the side of an anvil block which determines the length of the piece of wire to be formed into a staple. The wire is held by a pressure foot against the surface of the anvil. A forming blade is positioned on each side of the pressure foot. One of the forming blades cuts the wire and then the pair of forming blades move to bend the length of wire against each side of the anvil. A spring biased stripper member is held away from the surface of the anvil during the measuring, cutting and staple forming steps. After a staple is formed the forming blades and pressure foot move back from the anvil enabling the stripper member to remove the formed staple from the anvil and deposit it in a channel in a guide member. A driving blade then drives the staple from the guide channel into a workpiece. In subsequent cycles, the forming blades form a new staple while the driving blade drives the staple formed in the previous cycle.

DETAILED DESCRIPTION OF THE PREFERRED EMBODIMENTS

Figure 1:
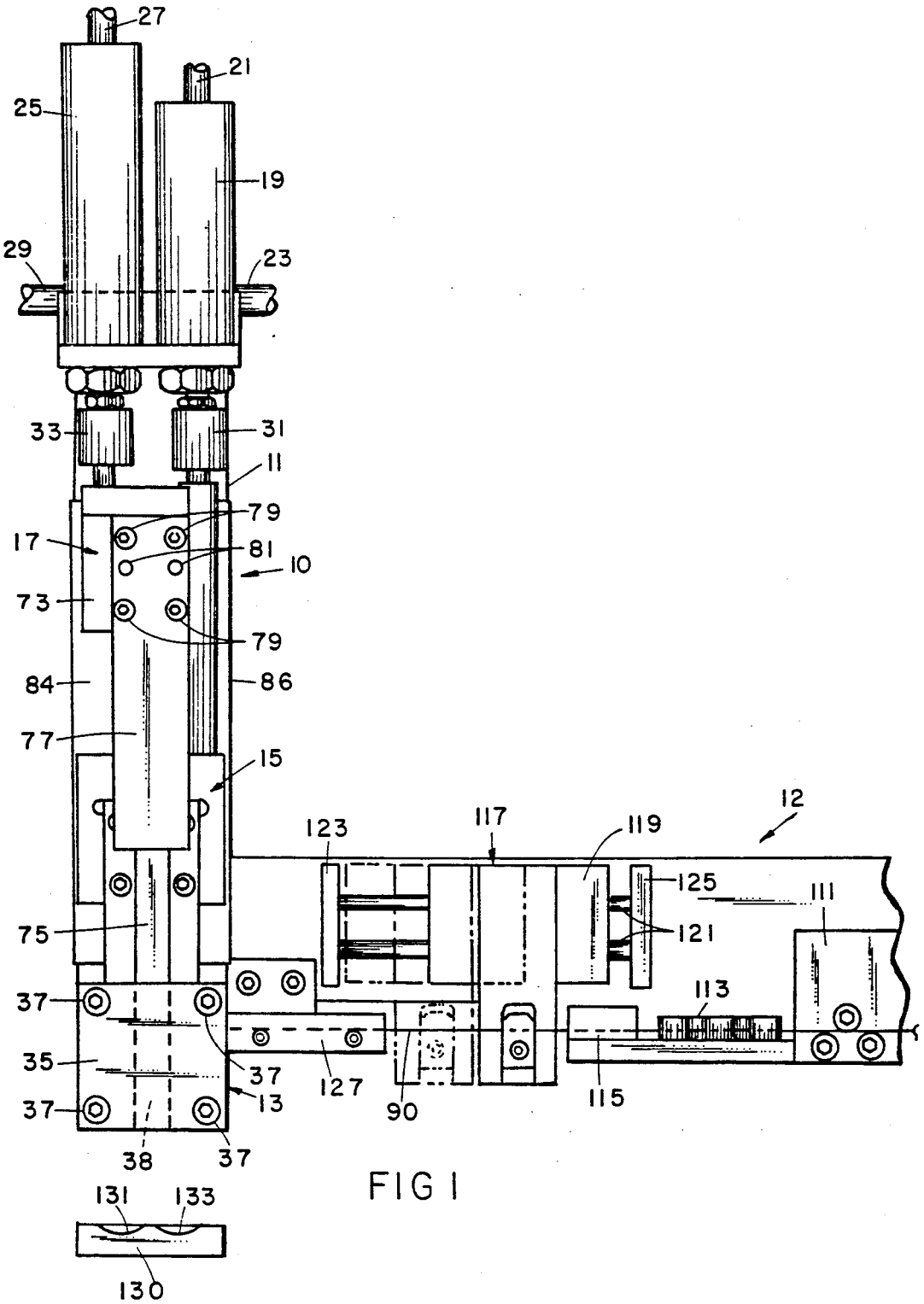
FIG. 1 is a front elevational view of the wire feeding, staple forming and driving apparatus.
Figure 2:
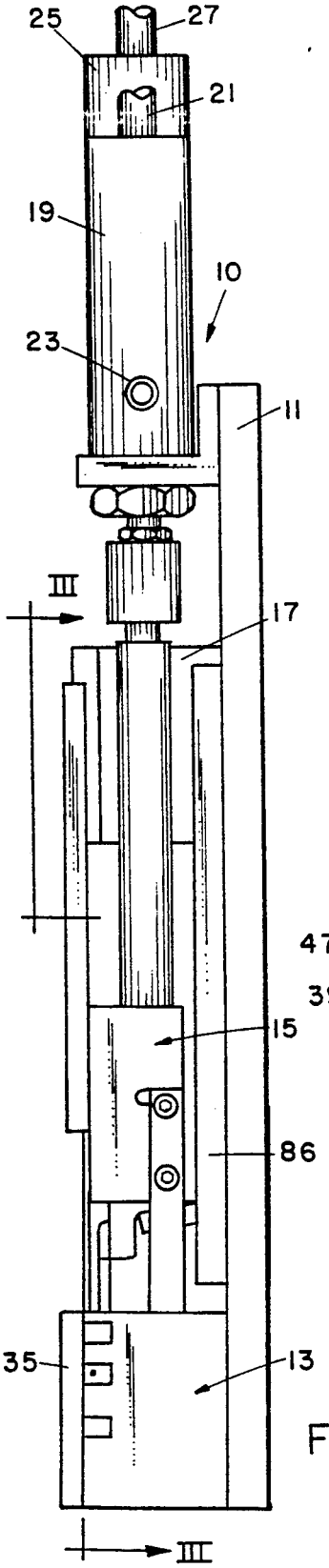
FIG. 2 is a side elevational view of the staple forming apparatus.

Referring to FIG. 1, the staple forming mechanism is indicated generally by the number 10 and the wire feeding mechanism is indicated generally by the number 12. The staple forming mechanism has a base plate 11 on which is mounted a stationary anvil block 13, a movable staple forming block 15 and a movable staple driving block 17. Staple forming block 15 is moved back and forth by a double acting pneumatic cylinder 19 which has an input 21 for driving the piston (not shown) downwardly, as shown in FIGS. 1 and 2, and an input 23 for reversing the direction of the piston or moving it upwardly. The staple driving block 17 is driven by a pneumatic cylinder 25 which has an input 27 driving the piston (not shown) downwardly and a return input for driving the piston upwardly. A pair of substantially identical shaft alignment couplers 31 and 33 ar used for making fine adjustments of the length of the drive stroke of staple forming block 15 and staple driving block 17.

Anvil block 13 is mounted at the end of plate 11 above where a workpiece would be positioned to receive a staple. A cover 35 is mounted on the anvil block by four spaced screws 37. The underside of cover 35 has a machined guide channel 38, shown in phantom, for receiving and guiding a staple. Guide channel 38 is approximately the same width and depth as a staple.

Figure 3A:
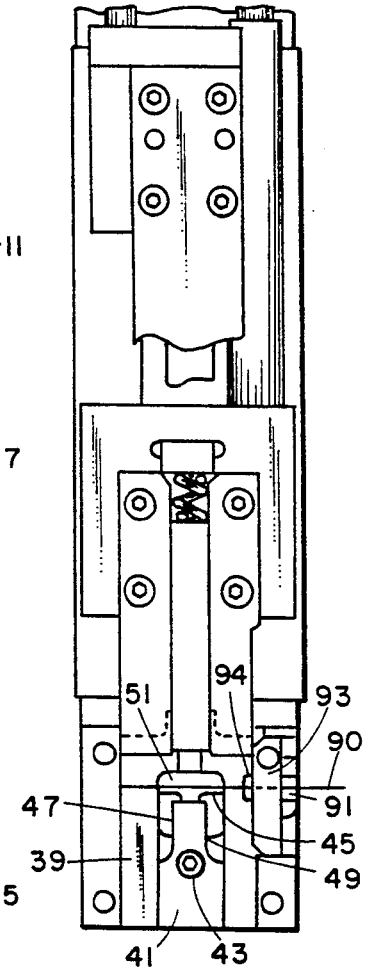
FIG. 3*a* is an elevational view, with parts removed for clarity, showing a length of staple forming wire extending across the interior of the apparatus.
Figure 3B:
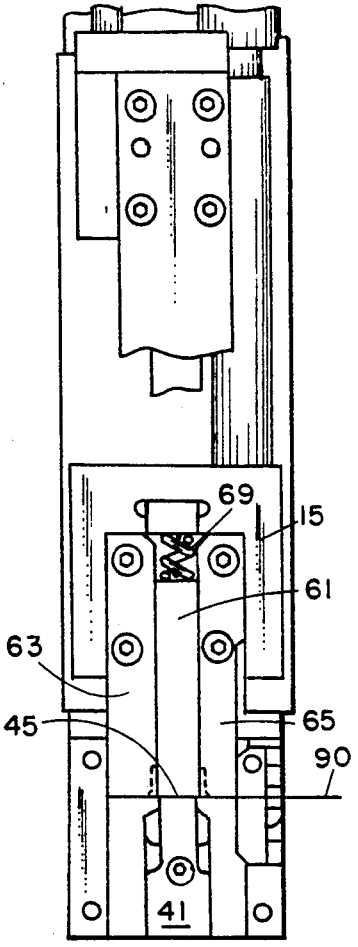
FIG. 3*b* shows the pressure foot holding the wire against the anvil.
Figure 3C:
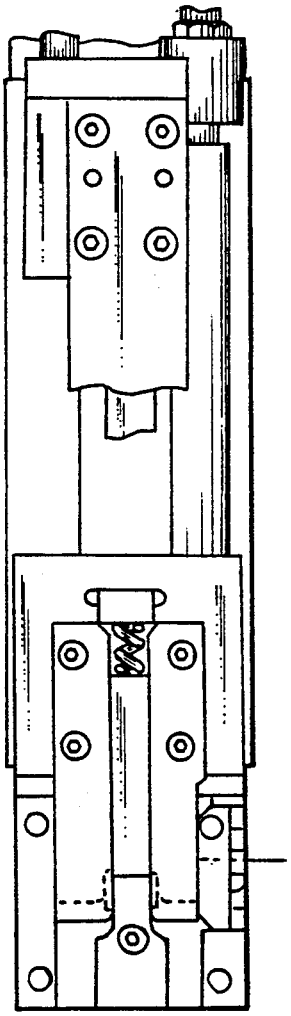
FIG. 3*c* shows the staple forming blades, after having cut the wire, shaping the wire about the anvil.
Figure 3D:
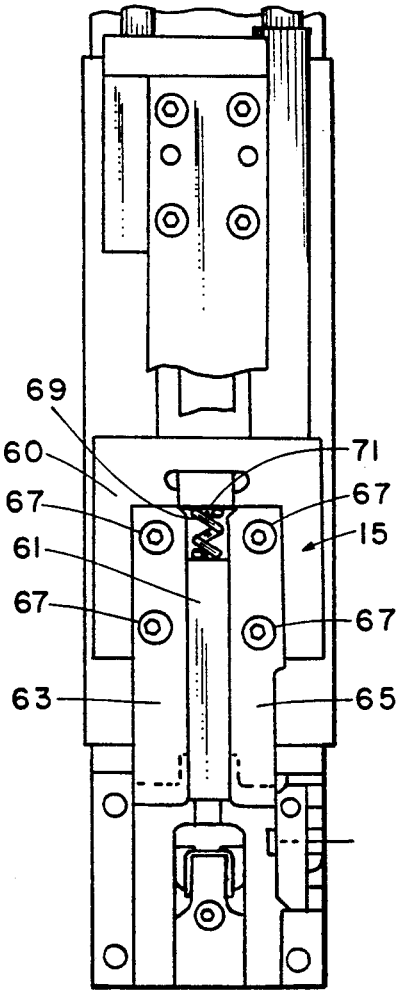
FIG. 3*d* shows the formed staple about the top of the anvil before being stripped off.
Figure 3E:
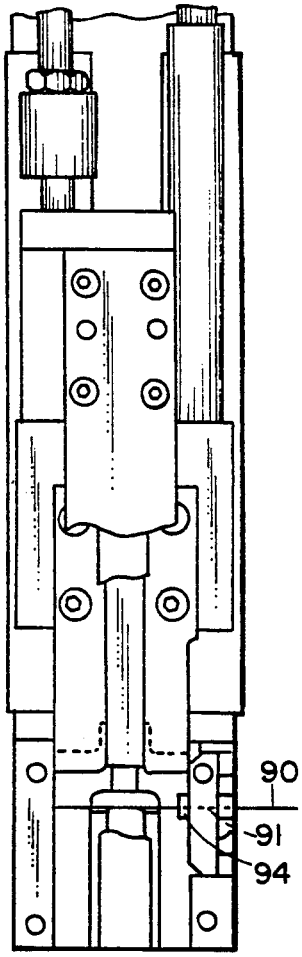
FIG. 3*e* shows the finished staple out of the machine with a length of wire in place to form the next staple.
Figure 3F:
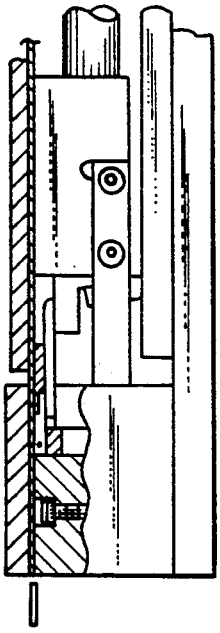
FIG. 3*f* is a side elevational view partially in section showing the driver blade after having driven the finished staple from the apparatus.
Figure 3G:
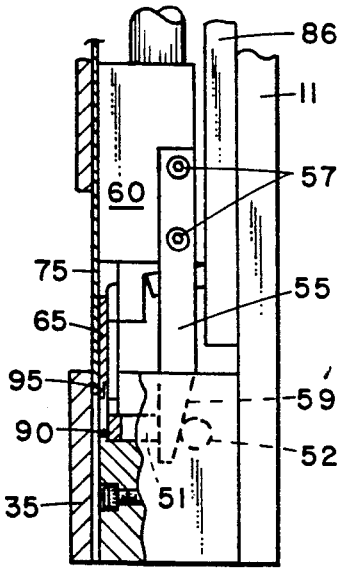
FIG. 3*g* is a side elevational view, partially in section, showing the wire extending across the top of the anvil.

The anvil block, as shown in FIGS. 3*a* and 3*g*, has a frame member 39 upon which an anvil member 41 is mounted. The anvil member is held in position by a threaded screw 43. Anvil member 41 has a working face 45 and shaped side portions 47 and 49. The side portions are tapered inwardly so that each leg of a staple being formed can be slightly over-bent, beyond a right angle, to compensate for the memory of the staple forming wire.

Figure 4:
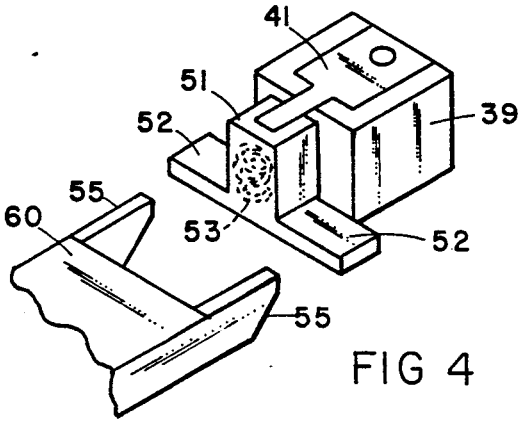
FIG. 4 is a schematic view of the anvil, stripper and camming members.

A staple stripping member 51 is positioned adjacent the anvil member and in working relationship with the face and sides of the anvil member. The stripping member 51 (FIG. 4) is of an inverted T-shape with each side of the "T" 52 forming a camming surface. A spring 53 is recessed in a blind hole in the center of the "T." Spring 53 urges the stripper to the left, as shown in FIG. 3*g* or upwardly, as shown in FIG. 4, where the stripper has removed a formed staple from anvil member 41 and deposited it in guide channel 38 in cover 35.

A formed staple preferably has each leg bent at a right angle to the back of the staple. A staple of this configuration will be guided smoothly through guide channel 38 in cover 35. On the other hand, if the legs of the staple are not bent inwardly enough they will tend to dig into or scratch the sides of the guide channel. If the legs are bent too far inwardly, the staples can cant or cock as they move through the guide channel. In either of the aforementioned situations the staple will not enter the workpiece properly.

As mentioned previously, staple stripper 51 is normally biased to the staple stripping position. In order to load a length of wire into the staple forming apparatus, the stripper must be moved clear of the face of anvil member 41. As shown in FIGS. 3*g* and 4, a pair of substantially identical camming members 55 are mounted on each side of staple forming block 15 by a pair of threaded screws 57. As the staple forming block moves toward the anvil block the camming surfaces 59 on each camming member 55 enter an opening (not shown) on the side of the anvil block. The camming surfaces contact the camming surfaces on each side of inverted T-shaped stripper member 51, causing the stripper member to move away from anvil member 41.

Staple forming block 15 (FIGS. 3*d* and 3*g*) has a frame member 60 slidably mounted on the top of base plate 11. A pressure foot 61 is slidably mounted on the top of frame 60 between a pair of substantially identical staple forming blades 63 and 65. The staple forming blades are held in position on the surface of frame member 60 by threaded screws 67. Each side of pressure foot 61 is guided in a channel (not shown) in the opposed or facing surfaces of staple forming blades 63 and 65. The pressure foot has a bias spring 69 acting on one end to enable the foot to apply pressure to the staple forming wire and to enable the staple forming blades to continue forward after the pressure foot has gripped the wire to bend the unsupported ends of the wire against the sides of anvil member 41. Spring 69 can have one or more shims 71 to precisely determine the position of the pressure foot relative to the staple forming blades.

Driving block 17 has a frame member 73 (FIG. 1) slidably mounted on the top of base plate 11. A staple driving blade 75 is fastened to frame member 73 and extends over staple forming block 15 to be held in place in guide channel 38 formed on the bottom of anvil block cover plate 35. A guide member 77 is attached to the top of frame member 73 by threaded screws 79. Guide member 77 has a pair of spaced guide pins 81 which project from the top surface of frame member 73. Guide member 73 has a machined channel (not shown) for holding driving blade 75 in precise alignment with guide channel 38 in anvil block cover 35. In order to facilitate the movement of staple forming block 15 and staple driving block 17, a layer of Rulon, a Teflon impregnated material available from the Welker Corporation, of Detroit, Mich., is mounted on the face of base plate 11 under the two moving blocks. Other similar lubricating materials can also be used.

A pair of spaced guide rails 84 and 86 are provided on each side of base plate 11. Each guide rail has an elongated channel for receiving an extending portion of each of movable blocks 15 and 17. The guide rails keep the moving blocks aligned on base plate 11.

In the operation of the staple forming and driving machine, it will be recalled that the stripper member is normally in the position where it would lie after having stripped the formed staple from the anvil. The staple forming block advances toward the anvil block to cause camming surfaces 59 on camming arms 55 to contact arms 52 of T-shaped stripper member 51 causing the stripper member to be pulled away from the anvil. Now referring to FIG. 3*a*, a length of wire 90 is now passed into the side of the staple forming machine until it contacts the opposite side. The wire enters through an orifice 91 in block 93. A ramp-shaped recess 94 in the top surface of frame member 39 assures that the wire properly feeds into the machine. The wire extends across the machine with the distance between the inner edge of orifice member 91 and the opposite side of the machine determining the length of the wire to be formed into a staple. In the preferred embodiment, this length is approximately one and one-half inches, with face 45 of anvil member 41 being approximately one-half inch in width so that the staple, when shaped, will have two one-half inch long legs joined by a one-half inch wide back. The preferred wire for forming the staples is 0.025 inch zinc plated steel wire which is readily available in roll form from Stanley-Bortitch Inc., and other suppliers.

Figure 3H:
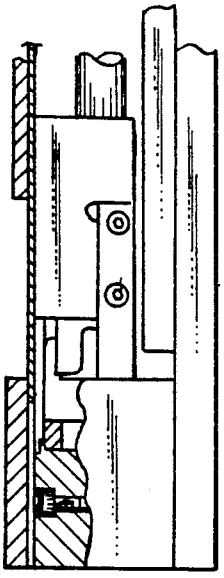
FIG. 3*h* is a side elevational view showing one of the staple forming blades before it cuts the wire.

With the preferred length of wire 90 in the machine, staple forming block 15 continues to advance bringing pressure foot 61 into contact with wire 90 holding the wire firmly in place against face 45 of anvil member 41. The staple forming block continues to move with the pressure foot held in place by spring 69 as staple forming blades 63 and 65 continue to advance. The pressure of the foot keeps the wire straight during the staple forming process. It can be seen in FIGS. 3*g* and 3*h* that the leading edge of the staple forming blade is ramp-shaped to press the wire down against the top of stripper member 51 and against the face of anvil member 41. Each stripper blade has a notch-like portion 95 removed from the leading edge and extending back a short distance along the surface of the forming blade. The notch is approximately 0.026 inch deep, slightly larger than the diameter of the staple forming wire. As the staple forming blades advance, the tapered leading edge scrapes the wire down urging it into notch 95. The blades continue to advance and as a forming blade passes orifice member 91 the wire is cut off by the sharp edge of the notch. The forming blades continue onwardly while the pressure foot is held in place by spring 69 until the free ends of the length of wire are bent along each side of anvil member 41. The pressure foot is substantially the same width as the anvil face to hold the back of the staple straight as the legs are bent. As mentioned previously, the wire is preferably over-bent to compensate for the memory inherent in wire which causes the wire to spring back. Also, the sharp edges of the notch in each staple forming blade coins the sides of the staple removing any shoulder that might form.

After the staple has been formed (FIG. 3*d*) staple forming block 15 withdraws from the anvil block enabling stripper member 51 to drive the formed staple into machined guide channel 38 in the surface of cover 35. The staple is held in place in the guide channel. The staple forming block now advances again, again camming down stripping member 51 in preparation for forming a new staple. Once the stripper member has been moved out of the way, anvil driving block 17 advances causing driving blade 71 to contact the staple supported in the machined guide channel in cover plate 3 driving the staple out of the staple forming apparatus and into the workpiece. After driving the staple, the driving block returns to its home position and the staple forming block continues its advance holding the stripper member down and a new length of wire is fed into the machine. The process then repeats itself continuously with the formed staple being driven into the workpiece by the driving blade while the next staple to be made is being formed.

Referring again to FIG. 1, bulk wire 90 is supported on a reel or spool (not shown) and is fed from that spool into a pair of substantially identical wire straighteners 111 and 113. Each of the straighteners has a plurality of opposed rollers. As shown in FIG. 1, straightener 111 would tend to straighten the wire in the up and down direction while straightener 113 would straighten wire in the direction into and out of the plane of the paper.

After passing through the two straighteners the wire passes through a guide 115 to a crimper slide 117 which has a movable carriage 119 supported on a pair of guide rails 121 which are supported at each end by guide rail supports 123 and 125. Carriage 119 has a double acting pneumatic cylinder (not shown) which can drive the crimper slide to the left pulling approximately one and one-half inches of wire off the spool and through the straighteners and pushing the wire through an additional guide 127 into guide member 91 on the side of the staple forming machine. When the crimper slide moves to the right, as shown in FIG. 1, it passes freely over wire 90. On the return or left stroke, the wire is gripped by the crimper slide and is moved toward the staple forming machine.

As can be seen from the previous description, the staple forming and driving machine has a plurality of pneumatic cylinders which are actuated at different times to perform different operations. The control and timing of all of the pneumatic cylinders can be carried out by a simple electronic timing device or microprocessor, as is well known in the art. It should also be noted that the pneumatic cylinder for the driving block and blade has approximately a two inch stroke in order to carry the driving blade over the full length of the anvil block to drive the staple into the workpiece. On the other hand, a pneumatic cylinder for the staple forming block has approximately a one inch travel.

Also, in order to bend the staple after it passes through the workpiece, a clincher block 130 is provided below the workpiece. The clincher block has a pair of substantially identical, smooth guideways 131 and 133 for bending the ends of the staple toward each other and back toward the workpiece. If desired, the point of contact of the staple with guides 131 and 133 can be changed so that the ends of the staples are bent away from each other. This is a matter of choice depending primarily upon the materials being worked with and the requirements of the stapling operation.

Though the invention has been described with respect to a specific preferred embodiment thereof, many variations and modifications will become apparent to those skilled in the art. It is therefore the intention that the appended claims be interpreted as broadly as possible in view of the prior art to include all such variations and modifications.

The embodiments of the invention in which an exclusive property or privilege is claimed are defined as follows:

1. A staple forming and driving apparatus comprising:

a anvil block including:

an anvil member upon which a staple can be formed;

a spring biased stripper member for removing a formed staple from said anvil member;

a guide member having a channel therein for receiving and supporting a staple removed from said anvil member by said stripper member; and a forming block movable toward and away from said anvil block, said forming block including:

at least one projecting stripper cam for moving said stripper member away from said anvil member as said forming block approaches said anvil block;

a pressure foot for holding a length of wire on said anvil member; and a forming blade on each side of said pressure foot for cutting said wire and for shaping said cut wire into a staple on said anvil member; and a driving block movable toward and away from said forming block, said driving block including:

a driving blade for driving staples from said guide member into a workpiece; and a containment cover for said driving blade.

2. A staple forming and driving apparatus as set forth in claim 1, wherein said anvil block has a pair of spaced sides, one of which has an aperture therein for receiving wire to be formed into a staple and the other of said sides provides an abutting surface for said wire thereby determining the length of wire to be formed into a staple.

3. A staple forming and driving apparatus as set forth in claim 1, wherein said anvil member has tapered sides to enable the sides of a staple to be bent past a right angle relative to the back of a staple to compensate for memory in the wire.

4. A staple forming and driving apparatus as set forth in claim 1, wherein said stripper member is shaped to fit around the face and sides of said anvil to keep a staple straight while it is being stripped and pushed into said guide channel in said guide member.

5. A staple forming and driving apparatus as set forth in claim 1, wherein said stripper member has at least one cam follower surface for cooperating with a stripper cam on said forming block to move said stripper member away from said anvil member during the staple forming operation and for stripping a formed staple off said anvil member at the end of the staple forming process when said stripper cam recedes from said stripper member.

6. A staple forming and driving apparatus as set forth in claim 1, wherein said pressure foot is spring biased to hold a length of wire in position for said forming blades.

7. A staple forming and driving apparatus as set forth in claim 1, wherein at least one shim is used to cause said spring biased pressure foot to have substantially zero clearance with a length of wire to be formed into a staple.

8. A staple forming and driving apparatus as set forth in claim 1, wherein the bottom edge of each of said forming blades slopes downward to hold said wire to be formed into a staple against said anvil member.

9. A staple forming and driving apparatus as set forth in claim 8, wherein the sloping portion of each of said forming blades ends in a step surface which is used to bend each end portion of a length of wire about said anvil member.

10. A staple forming and driving apparatus as set forth in claim 9, wherein one edge of said step on said forming blades cooperates with an aperture in said anvil block to cut a length of wire.

11. A staple forming and driving apparatus as set forth in claim 9, wherein the edge of said forming blades adjacent said anvil is shaped to coin the surface of the staple leg to remove any projection from said wire caused by the bending or drawing of the wire.

12. A staple forming and driving apparatus as set forth in claim 1, wherein said containment cover for said driving blade extends over said staple forming block when said driving blade is driving a staple.

13. A staple forming and driving apparatus as set forth in claim 12, wherein said containment cover has a channel therein for guiding said driving blade.

14. A staple forming and driving apparatus as set forth in claim 1, further including a clinching means for said staple, said clinching means comprising a pair of recessed surfaces in a block for bending each leg of a staple.

15. A wire staple forming and driving apparatus comprising:

an anvil block comprising a pair of spaced walls for measuring a length of wire therebetween and an anvil member positioned between said spaced walls, said anvil member having a face surface and side surfaces for shaping a measured length of wire into a staple;

a stripper member movably mounted in said anvil block, said stripper member having a shaped working surface for stripping a formed staple off said anvil member;

a cam follower surface on said stripper member for causing said stripper member to retract away from said anvil member into said anvil block under the influence of a cam surface;

a guide member on said anvil block, said guide member having a staple guide channel therein positioned to receive a formed staple from said stripper member;

a forming block adapted to move toward and away from said anvil block in forming a staple;

a camming member extending from said forming block toward said anvil block, said camming member having a camming surface thereon for causing said stripper member to withdraw from said anvil member as said forming block approaches said anvil block;

a spring loaded pressure foot on said forming block for holding a portion of a length of wire against said face surface of said anvil member;

a forming blade on each side of said pressure foot, said forming blades bend the ends of said length of wire about said anvil member to form a staple;

a driving block adapted to move toward and away from said forming block; and a driving blade on said driving block for driving a formed staple through said guide member on said anvil block.

16. A wire staple forming and driving apparatus as set forth in claim 15, wherein said stripper member surrounds the face and part of each side of said anvil member.

17. A wire staple forming and driving apparatus as set forth in claim 15, wherein said pressure foot is substantially the same width as said face surface of said anvil member.

18. A wire staple forming and driving apparatus as set forth in claim 15, wherein at least one shim is used to bias said pressure foot toward said anvil member.

19. A wire staple forming and driving apparatus as set forth in claim 15, wherein said stripper member is normally spring biased to the staple stripping position on said anvil member.

* * * * *

UNITED STATES PATENT AND TRADEMARK OFFICE

CERTIFICATE OF CORRECTION

PATENT NO. : 5,147,080

DATED : September 15, 1992

INVENTOR(S) : Kenneth Assink et al.

It is certified that error appears in the above-identified patent and that said Letters Patent is hereby corrected as shown below:

column 2, line 23:
after "input" insert --29--;

column 2, line 25:
"33 ar" should be --33 are--;

column 4, line 52:
"3 driving" should be --35 driving--.

Signed and Sealed this

Thirtieth Day of November, 1993

*Attest:*

*Attesting Officer*

BRUCE LEHMAN

*Commissioner of Patents and Trademarks*